US007380793B2

(12) United States Patent
Schroeder et al.

(10) Patent No.: US 7,380,793 B2
(45) Date of Patent: Jun. 3, 2008

(54) MARBLE BOARD GAME

(75) Inventors: Del C. Schroeder, Warren, MI (US); Janet L. Schroeder, Warren, MI (US)

(73) Assignee: Dellightful Games, LLC, Warren, MI (US)

( * ) Notice: Subject to any disclaimer, the term of this patent is extended or adjusted under 35 U.S.C. 154(b) by 108 days.

(21) Appl. No.: 11/300,157

(22) Filed: Dec. 14, 2005

(65) Prior Publication Data

US 2007/0132180 A1 Jun. 14, 2007

(51) Int. Cl.
*A63F 3/00* (2006.01)

(52) U.S. Cl. ..... 273/264; 258/271

(58) Field of Classification Search ..... 273/258, 273/264, 271

See application file for complete search history.

(56) References Cited

U.S. PATENT DOCUMENTS 5,386,994 A * 2/1995 Baranowski ..... 273/249
5,433,450 A * 7/1995 Vaillancourt ..... 273/248
5,758,876 A * 6/1998 Frick et al. ..... 273/248

* cited by examiner

*Primary Examiner*—Vishu K. Mendiratta
(74) *Attorney, Agent, or Firm*—Harness, Dickey & Pierce, P.L.C.

(57) ABSTRACT

A game is provided that generally includes a structure having a first playing surface. The playing surface includes a plurality of marked spaces. A first group of marked spaces form a perimeter, a second group of marked spaces extend from the first group of marked spaces and form a series of starting regions, and a third group of marked spaces extend from the first group of marked spaces and form a series of home regions. Each of the adjacent starting regions has an equal number of marked spaces from the first group disposed therebetween. Each of the adjacent home regions has an equal number of marked spaces from the first group disposed therebetween. Movable pieces are provided that are configured for movement between the marked spaces. A move-determining structure configured for determining a number of marked spaces that a player may move one of his movable pieces is also provided.

3 Claims, 5 Drawing Sheets

FIG. 15
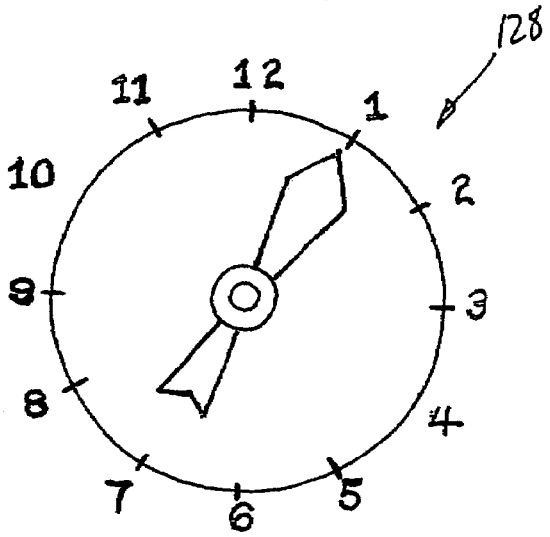
FIG. 16
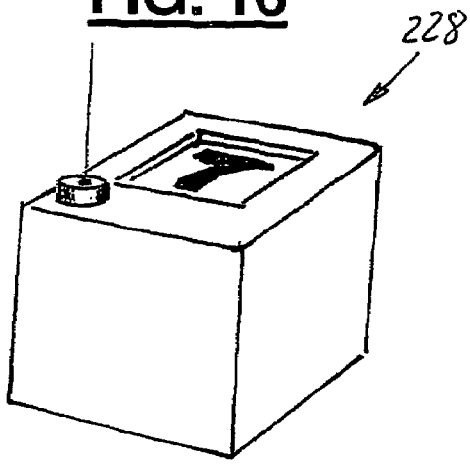
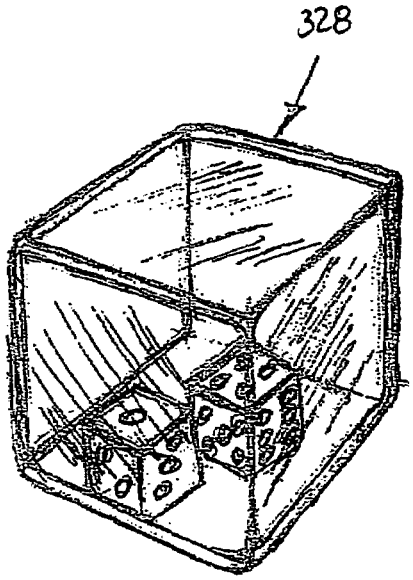
FIG. 17

MARBLE BOARD GAME

FIELD OF THE INVENTION

The present invention relates to a game, and more particularly to a game having pieces moveable about a playing surface based on strategy and luck and involving multiple players.

BACKGROUND AND SUMMARY OF THE INVENTION

A number of games exist that provide amusement for individuals. These games provide entertainment and the opportunity for friendly competition with others.

The present invention provides a new game for multiple players. The game generally includes a structure having a first playing surface. The playing surface includes a plurality of marked spaces. A first group of marked spaces form a perimeter, a second group of marked spaces extend from the first group of marked spaces and form a series of starting regions, and a third group of marked spaces extend from the first group of marked spaces and form a series of home regions. Each of the starting regions has an equal number of marked spaces from the first group disposed therebetween. Each of the home regions has an equal number of marked spaces from the first group disposed therebetween. Movable pieces are provided that are configured for movement between the marked spaces. A move-determining structure configured for determining a number of marked spaces that a player may move one of his movable pieces is also provided.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 15 is a plan view of an alternate spinner-type move-determining structure;

FIG. 16 is a perspective view of an alternate electronic-type move-determining structure; and FIG. 17 is a perspective view of an alternate dice-type move-determining structure.

DETAILED DESCRIPTION OF THE PREFERRED EMBODIMENTS

The following description of the preferred embodiments is merely exemplary in nature and is in no way intended to limit the invention, its application, or uses.

With reference to the figures, a game is provided that includes a game board 10, a player identifying piece 24 and a move-determining structure 28.

Figure 1:
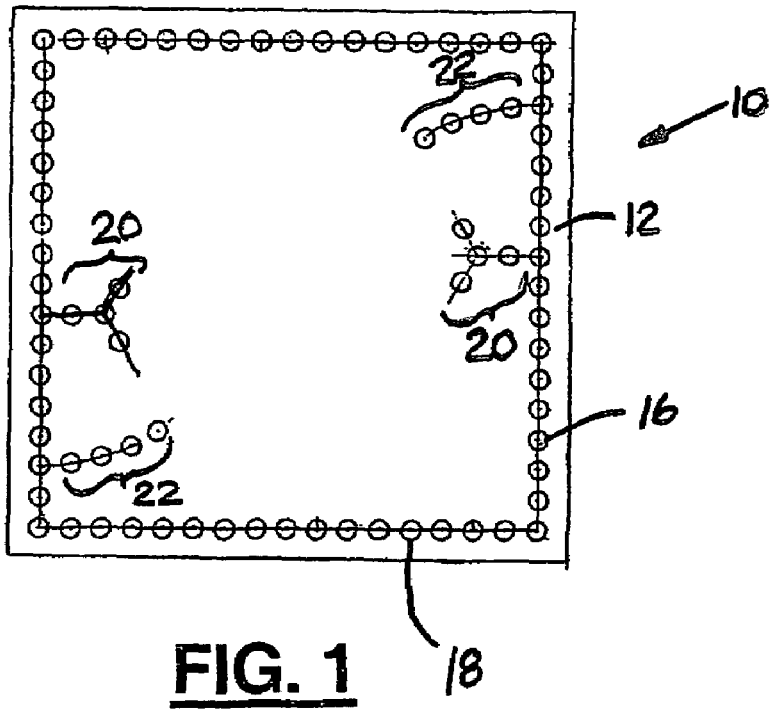
FIG. 1 is a perspective view of the game board of the present invention.

In FIG. 1, a game board 10 is shown generally in the shape of a square. The game board has an upper surface 12 and a lower surface 14. The upper surface 12 includes a plurality of marked spaces 16 thereon. A first group of marked spaces 16 forms a perimeter section 18 extending around a perimeter of the game board 10. A second group of marked spaces 16 forms a series of starting sections 20. A third group of marked spaces 16 forms a series of home sections 22.

Figure 2:
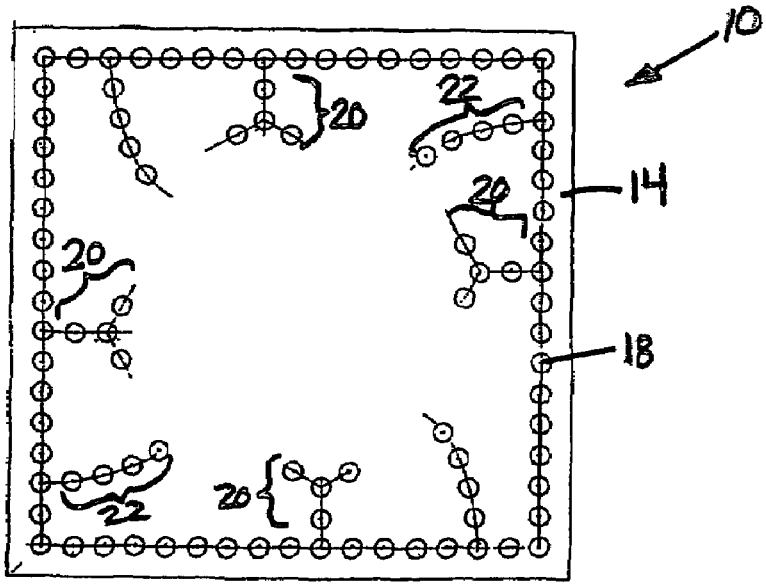
FIG. 2 is a plan view of a second surface of the game board of FIG. 1.
Figure 3:
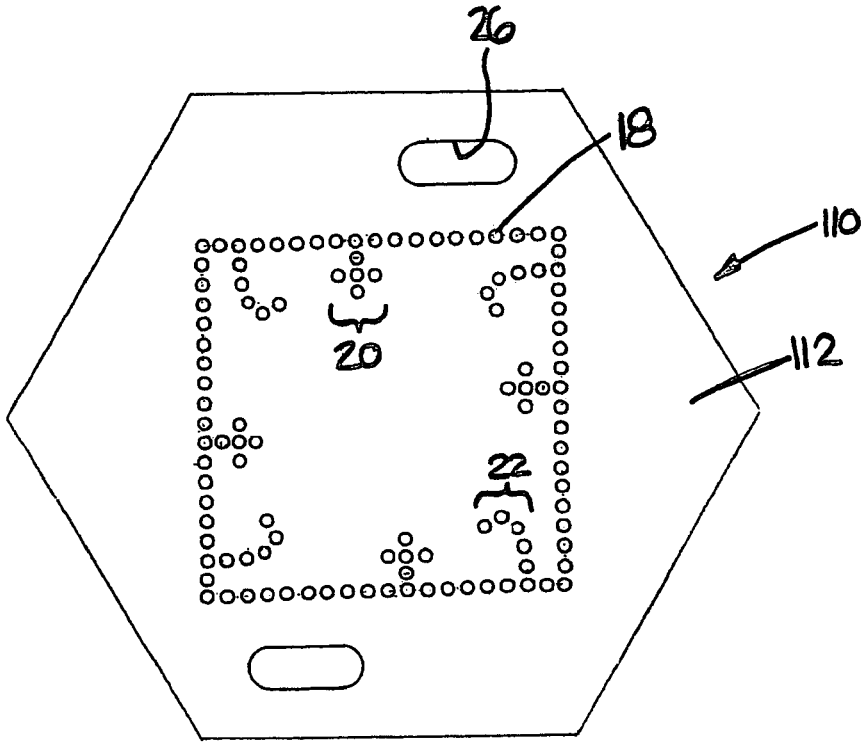
FIG. 3 is a plan view of an alternate embodiment of the game board of the present invention.
Figure 4:
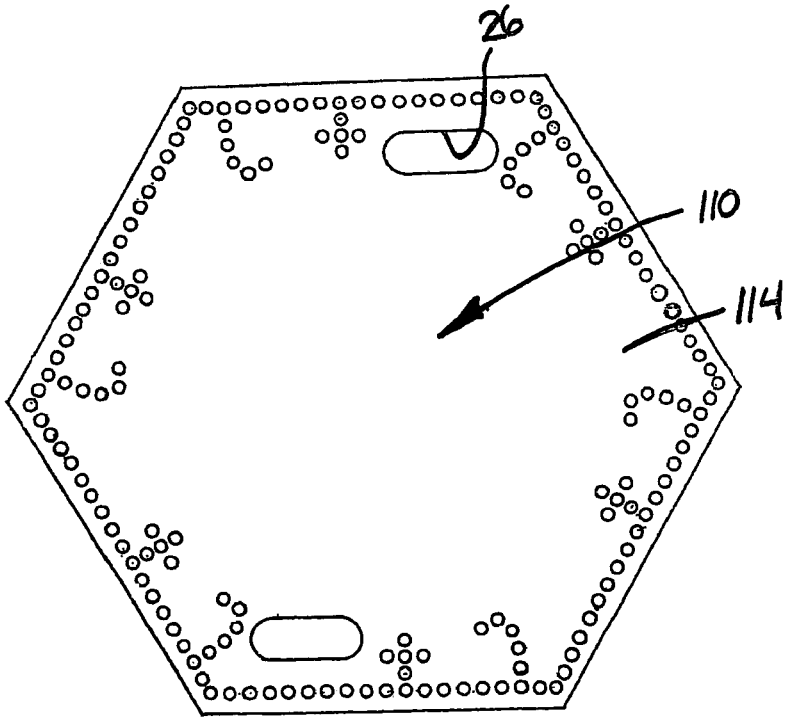
FIG. 4 is a plan view of a second surface of the game board of FIG. 3.

The perimeter section 18 on each side of the square game board 10 is shown having 17 marked spaces 16. However, it should be understood that any number of marked spaces 16 may be provided as long as the number of marked spaces between each player's starting section 20 and home section 22 is the same and that the number of marked spaces between each adjacent starting section is the same. FIG. 1 shows a board 10 configured for a two-player game having thirty-four (34) marked spaces 16 between each player's starting section 20. However, it should be noted that numerous other configurations are possible. Preferably, the number of spaces 16 between players are between four (4) and forty (40). A few of the many other examples are shown in FIGS. 2-4. FIG. 2 illustrates a second side 14 of board 10 and includes a perimeter 18 of spaces 16 and includes four equally spaced starting sections 20 and home sections 22. The lower surface 14 may include a greater or lesser number of marked spaces 16 in order to accommodate a lesser or greater number of players. The upper surface 12 is arranged for two (2) players with two (2) starting sections 20 and two (2) home sections 22. Lower surface 14 is arranged for up to four (4) players with four (4) starting sections 20 and four (4) home sections 22. It should be noted that it is possible for a lesser number of players to be able to play on surfaces 12, 14 even if they are arranged for a greater number of players. The lower surface 14 is similar to the upper surface 12 as described above except all four sides include a home section 22 and a starting section 20.

Each starting section 20 includes four marked spaces 16. The starting section 20 is shown formed as a Y-shape. However, it should be noted that any shape that may be formed from the marked spaces 16 may be used. By way of further example, the marked spaces 16 of the starting section 20 can be arranged as an arrow for indicating the start position. It should also be noted that the starting section 20 may include more or less than four (4) marked spaces 16.

Each home section 22 includes four marked spaces 16 as well, the same as the starting section 20. The home section 22 is shown formed as an arc shape. As noted above, it should be noted that any shape that may be formed from the marked spaces 16 may be used. Preferably, the home section 22 has a shape different from the shape of the starting section 20. By way of further example, the marked spaces 16 of the home section 22 can be arranged as a house for indicating the home position. Also, as noted above regarding the starting section 20, the home section 22 may include more or less than four (4) marked spaces 16.

While the game board 10 has been described as having a square shape above, it should be noted that almost any shape is suitable, regardless of the number of players involved. For example, a game board 110 having a hexagonal (six-sided) shape may be used as shown in FIGS. 3 and 4. Other board shapes having 3, 5, 7, 8 and even more sides could also be used. The arrangement in FIGS. 3 and 4 shows an upper surface 112 arranged for four (4) players and a lower surface 114 arranged for six (6) players. Further, it should be noted that a handle 26 may be included as shown in FIGS. 3-4.

Figure 6:
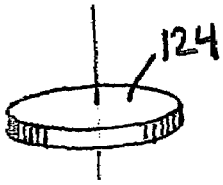
FIG. 6 is a perspective view of a token or coin game piece of the present invention.
Figure 5:
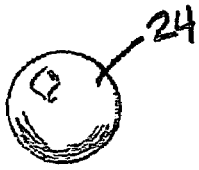
FIG. 5 is a perspective view of a marble game piece of the present invention.
Figure 7:
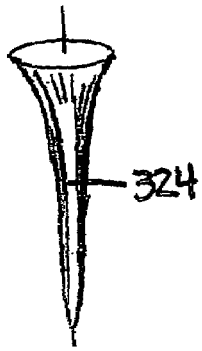
FIG. 7 is a perspective view of a golf-tee type game piece of the present invention.
Figure 8:
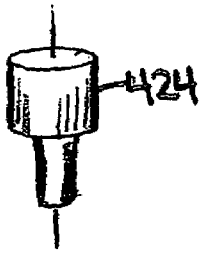
FIG. 8 is a perspective view of a peg game piece of the present invention.
Figure 9:
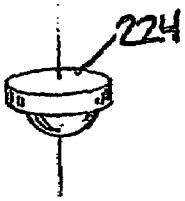
FIG. 9 is a perspective view of a button game piece of the present invention.
Figure 13:
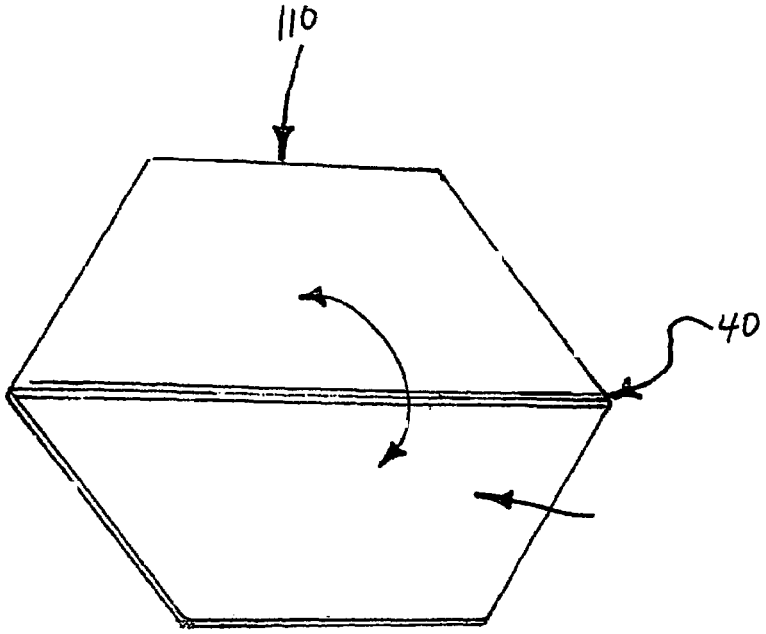
FIG. 13 is a perspective view of an alternative folding board according to the principles of the present disclosure.
Figure 14:
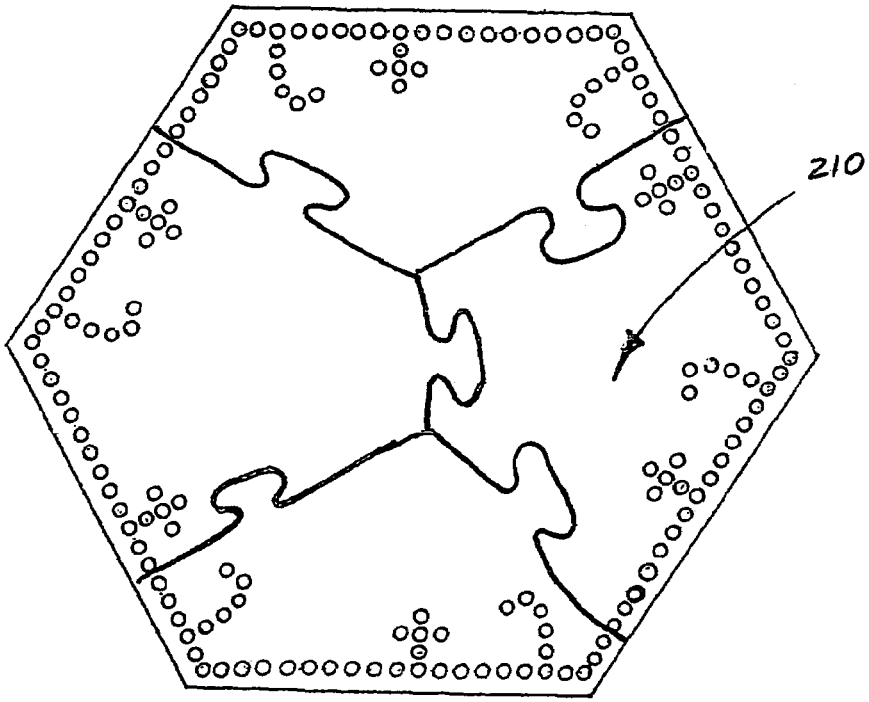
FIG. 14 is a plan view of an alternative puzzle-like board according to the principles of the present disclosure.

The marked spaces 16 may be arranged in a variety of ways including straight, curved, angled and serpentine shapes. Further, the marked spaces 16 may be coplanar, raised, lowered or a combination thereof relative to the upper and lower surfaces 12, 14. In the present example, the marked spaces 16 are semi-spherical or cylindrical recesses formed in the upper and/or lower surfaces 12, 14. The recesses are shaped to accept a player identifying piece 24 shown in FIG. 5. The game piece 24 in FIG. 5 is a marble. As such, the recesses in the present example are generally semispherical recesses. However, any configuration that prevents a game piece 24 from falling off the surfaces 12, 14 would suffice. For example, the player identifying piece 24 may take a variety of forms. If the player identifying piece 24 included a generally flat lower surface such as a token 124 shown in FIG. 6 or a button 224 shown in FIG. 7, then the marked spaces 16 may be flat as well. If the player identifying piece is a golf tee 324 as shown in FIG. 7 or a peg 424 as shown in FIG. 8, the marked spaces 16 may be holes. The marked spaces 16 may also include a color background or some other form of demarcation. The player identifying pieces 24, 124, 224, 324, 424 may be different colors and/or shapes or include any other distinguishing features for different players. The board 10 is preferably made from rigid material, such as plywood or partide board. Alternatively, the board 110 can be foldable with a hinge 40, as shown in FIG. 13, or can be formed as a puzzle 210, as shown in FIG. 14.

Figure 10:
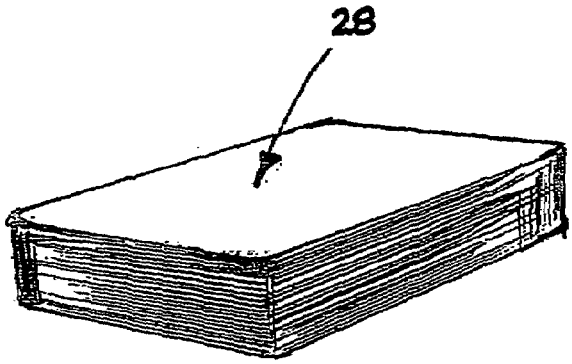
FIG. 10 is a perspective view of a move-determining card deck.
Figure 11:
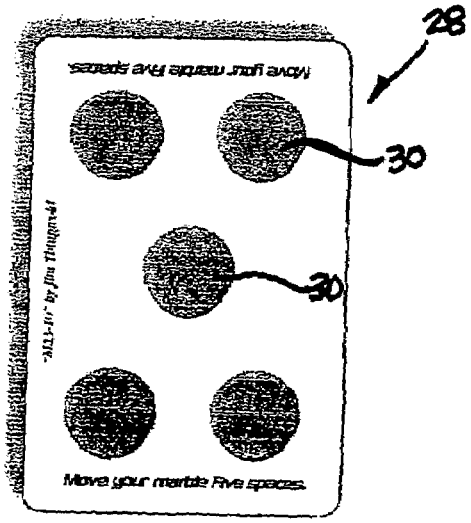
FIG. 11 is a plan view of an exemplary card according to the principles of the present disclosure.
Figure 12:
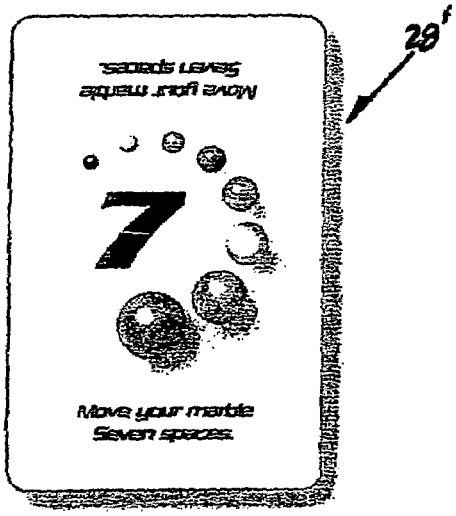
FIG. 12 is a plan view of an alternative card according to the principles of the present disclosure.

A move-determining structure may be a deck of common poker playing cards or other specially designed deck of cards 28, as shown in FIG. 10. As shown in FIG. 11, the cards 28 may include a plurality of dots 30 to indicate to the player the number of spaces to move their pieces 24 and to assist in teaching counting. Alternatively, as shown in FIG. 12, the card 28' can simply include a number to indicate the number of spaces to move. Alternatively, the move determining structure may be a spinner 128 as shown in FIG. 15, an electronic counter 228 as shown in FIG. 16, or a common six-sided dice or pair of dice that can be provided in a shaker, as shown in FIG. 17. The move-determining structure may generally take the form of anything that is capable of being adapted to determine the number of marked spaces 16 that a player may move his player identifying pieces 24.

The game may be played individually against an opponent or in teams. The game may be played by any number of players ranging from two (2) to the maximum supported by a given game board 10 configuration. Examples of some of the possible board arrangements and appropriate player combinations are as follows: two (2) players—two (2) individuals, three (3) players—up to three (3) individuals, four (4) players—up to four (4) individuals or two (2) teams, five (5) players—up to five (5) individuals, six (6) players—up to six (6) individuals or two (2) to three (3) teams, seven (7) players—up to seven (7) individuals, eight (8) players—up to eight (8) individuals or between two (2) to four (4) teams, nine (9) players—up to nine (9) individuals or three (3) teams, ten (10) players—up to ten (10) individuals or between two (2) to five (5) teams, eleven (11) players—up to eleven (11) individuals, twelve (12) players—up to twelve (12) individuals or two (2), three (3), four (4) or six (6) teams, thirteen (13) players—up to thirteen (13) individuals, fourteen (14) players—up to fourteen (14) individuals or between two (2) to seven (7) teams, fifteen (15) players—up to fifteen (15) individuals or three (3) or five (5) teams, sixteen (16) players—up to sixteen (16) individuals or between two (2) to eight (8) teams.

The game begins by placing a number of player identifying pieces 24 on the starting sections 20 of each of the players. In the present example, four (4) pieces 24 are used for each player. However, it should be noted that a lesser or greater number of pieces 24 may be used and still be within the scope of the game.

After this setup, a first player determines the number of marked spaces 16 that he may move using the move-determining structure. While it should be noted that a variety of move-determining structures may be employed, as previously mentioned, the preferred embodiment is described with the move-determining structure being a common or specialized deck of cards. Either a single deck or multiple decks may be used.

To begin the game, a first player deals each player five (5) cards, face down. The remaining cards are stacked and placed face down in the center of the board 10 by the dealer. As the game is played, cards are discarded and drawn from the stack, as discussed below. When the initial stacked cards are depleted, the dealer shuffles the discarded cards and places them face down in the place of the original stack. Once each player has selected his cards, a first player begins. The first player is the player immediately to the left of the dealer.

The first player draws an additional card from the stack, bringing his total number of cards to six (6). In order for the player to move his player identifying piece 24 from the starting section he must have a face card (jack, queen, or king), an ace, or a joker. If so, the player discards the face card, ace, or joker face up in front of himself and may then proceed to move one of his player identifying pieces 24 from the starting section 20 to a space immediately in front thereof, rendering that player identifying piece 24 "active." If the player does not have one of the previously noted cards, he may not move his player identifying piece 24 from the starting position 20 but still must discard one card face up as previously mentioned. The game continues to the player's left in a clockwise direction around the game board 10.

In each succeeding turn, a player draws a card and attempts to move. A player must move if able to do so. If a player is unable to move he still must continue to draw and discard, so that he has five (5) cards at all times. Even if a player has a face card, ace, or joker, he may not move one of his player identifying pieces 24 out of the starting section 20 if one of his player identifying pieces 24 is already located directly in front thereof.

Each of the player identifying pieces 24 must travel clockwise around the board 10 only once and eventually reach the home section 22 of that player. Exceptions exist for specific cards that will be discussed below.

A player may jump over the player identifying piece 24 of another player but may never jump over his own player identifying piece 24. If a player lands on the player identifying piece 24 of another player, that player identifying piece 24 of the other player is sent back to the respective starting section 20.

When a player's player identifying piece 24 is located immediately in front of his home section 22 he must play an ace through five or a seven (if able to be split to use less than five, as will be discussed below) to enter the home section 22. If a player does not have one of the above-mentioned cards or any other available moves, he must discard a card and wait until his next turn.

The cards in the deck have a variety of values, the value equaling the number of marked spaces 16 that a player may move his player identifying piece 24. Generally, the cards are worth their face value. Ace through ten are worth one (1) through ten (10) marked spaces 16, respectively, and face cards are worth ten (10) marked spaces. There are a few exceptions to the values noted above. A seven allows a player to split the seven (7) allowed marked spaces 16 between any two of his active player identifying pieces 24. Alternatively, the player may use the entire value of the seven for moving one player identifying piece 24. An eight requires the player to move an active player identifying piece 24 eight (8) spaces backwards. This may provide a shortcut for the player to move his player identifying piece 24 to the home section 22. Finally, a joker allows a player to take any one of his player identifying pieces 24 from any place on the board 10 and trade locations with an active player identifying piece 24 of any other player (including opponents or partners) that is in the perimeter section 18.

Once a player has moved a player identifying piece 24, and taken his hand off that piece 24, the move is final. That player must discard a card by the time the next player moves. If the player fails to do so he loses his turn.

The first player to have successfully moved all of his player identifying pieces 24, four (4) in the present example, to the home section 22 is the winner.

If playing with partners, there are several additional rules. First, if a player lands on his partner's player identifying piece 24, that piece 24 is sent to a location immediately before the home section 22. Next, the seven card may be used to split between moving a player's last player identifying piece 24 to his home section 22 and one of his partner's player identifying pieces 24.

A player may not assist his partner with move options while it is that partner's turn. If the player does so, that player loses his next turn. However, a player may remind his partner to draw a card during the partner's turn.

Once a player has all of his player identifying pieces 24 in his home section 22, he is permitted to assist an unfinished partner to move that partner's player identifying pieces 24. The finished partner continues drawing cards and discarding as normal, but plays the partner's player identifying pieces 24. The first team to get all of their player identifying pieces 24 to the home section 22 wins.

The game according to the principles of the present invention involves strategy with regard to which cards to play and which cards to hold, which player identifying piece to move and whether to play offensively or defensively.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of playing a game for at least two players, the game having a playing surface with a number of marked spaces thereon including a general perimeter path, a home location for each player, and a starting location for each player, said method comprising:

placing a plurality of player identifying pieces on the starting location for each player;

determining a number of marked spaces that a player may move;

the player moving a player identifying piece along the perimeter path the number of marked spaces determined in a first direction;

each of the players repeating said determining and said moving until one of said players reaches the home location with all of his player identifying pieces;

wherein said determining includes selecting at least one card from a deck of cards, each of said cards having a value of a number of spaces;

further comprising the player receiving a plurality of cards from the deck at the start of the game; and further comprising the player selecting a card and placing the selected card with the plurality of cards, forming a new plurality of cards, the player then discarding one of the cards from the new plurality of cards, the discarded card operating as said determining;

further comprising playing with partners, said repeating occurring until each of said partners has his player identifying pieces at the home location, wherein if a partner lands on one of his partner's player identifying pieces, that partner's player identifying piece is moved to a location immediately before his home location.

2. The method of claim 1, wherein the player may jump over the player identifying piece of another player, but may not jump over his own player identifying piece.

3. The method of claim 1, wherein the player identifying piece of a player is sent back to the starting location if another player lands thereon.

* * * * *